US006050646A

United States Patent [19]

Stenzel et al.

[11] Patent Number: 6,050,646

[45] Date of Patent: Apr. 18, 2000

[54] BACKREST

[75] Inventors: Thomas Stenzel; Michael Klaesener, both of Waldshut-Tiengen, Germany

[73] Assignee: Sedus Stoll AG, Waldshut-Tiengen, Germany

[21] Appl. No.: 09/208,242

[22] Filed: Dec. 9, 1998

[30] Foreign Application Priority Data

Dec. 10, 1997 [DE] Germany ..... 197 54 817

[51] Int. Cl.[7] ..... A47C 5/06; A47C 31/00

[52] U.S. Cl. ..... 297/452.59; 297/218.3; 297/218.4; 297/218.5; 297/440.11

[58] Field of Search ..... 297/218.3, 218.4, 297/218.5, 228.11, 440.11, 452.58, 452.59

[56] References Cited

U.S. PATENT DOCUMENTS 2,534,502 12/1950 Dewey ..... 297/218.43
3,995,892 12/1976 Hellman et al. ..... 297/218.4
4,784,436 11/1988 Sutherland ..... 297/440.11

FOREIGN PATENT DOCUMENTS 0 308 538 3/1986 European Pat. Off. .
295 07 702 U 8/1995 Germany .
295 16 375 U 2/1996 Germany .

*Primary Examiner*—Anthony D. Barfield
*Attorney, Agent, or Firm*—Oblon, Spivak, McClelland, Maier & Neustadt, P.C.

[57] ABSTRACT

A backrest, in particular for an office chair, is indicated, in which backrest a cover is stretched onto a frame. In order for it to be possible for the frame to be introduced into the cover in a simple manner, the frame is of hinged and rotatable design. The cover is stretched in the transverse and longitudinal direction by insertion of a transverse bow into the frame and fastening of the cover to the transverse bow.

8 Claims, 9 Drawing Sheets

BACKREST

DESCRIPTION

The invention relates to a backrest, in particular for an office chair, in accordance with the preamble of the first claim.

Backrests, in particular for chairs which are used in the office or commercial sector, have to take account of aesthetic and economic aspects as well as ergonomic aspects. From an ergonomic point of view, in addition to kinematic coupling to the seat surface of the chair, particular importance is also attached to shaping the backrest to fit a person's back and mounting it such that it can move. In this regard, European patent EP 0 303 538 indicates a movably mounted backrest which is configured in such a manner that it yields in a supporting manner both to sagital and also twisting and transversal movements of the back. This backrest comprises a fixed cushion shell in which a cushion is fitted. In addition to this backrest design, the so called membrane technique is also customary. In this technique, a cover is stretched onto a frame. Advantages of the membrane technique over backrests having fixed cushion shells include, in particular, the ease with which they can be produced and also the elegant and slender design. However, a disadvantage of known backrests in the membrane technique is that the covering of the frame with the cover cannot be easily undertaken and therefore compromises regarding the ergonomic shaping of the backrest have to be made. In addition, as the frame is being covered, the seams or, in the case of an exchangeable cover, the zip fastener are exposed to great stresses which can damage the cover or reduce its durability.

The invention is therefore based on the object of indicating a backrest using the membrane technique, which can be produced simply and cost-effectively, which also fully meets aesthetic and ergonomic requirements and has good durability. This object is achieved by the features of the first claim. The core of the invention is thus that the backrest frame is of hinged and downwardly open construction. The frame can thus be rotated to a certain extent. The frame can consequently be covered by the cover in a simple manner. The frame can then be brought into the final shape by the fitting of a transverse bow. The cover is thereby stretched in the transverse direction. Pulling the cover in the longitudinal direction towards the transverse bow produces three-dimensional shaping of the backrest surface, which shaping meets ergonomic requirements in the sagital and vertical and horizontal plane.

In a preferred exemplary embodiment, the frame has hinges in those corners which are opposite the transverse bow. The hinges can be of bent design in order to lift off the cover. A further preferred exemplary embodiment comprises the transverse bow being fitted with a groove into which a sewn-in profile of the cover can be placed. This constitutes an extremely simple manner of fastening the cover to the transverse bow, and in addition to a defined tensioning of the cover in the longitudinal direction permits fastening without protruding loose threads or annoying stitching. Further embodiments result from the corresponding, dependent claims.

In the following, the invention is explained in more detail with reference to drawings, in which.

The reference numbers are summarized in the list of reference numbers. In the figures, identical parts are provided with the same reference numbers.

Figure 1:
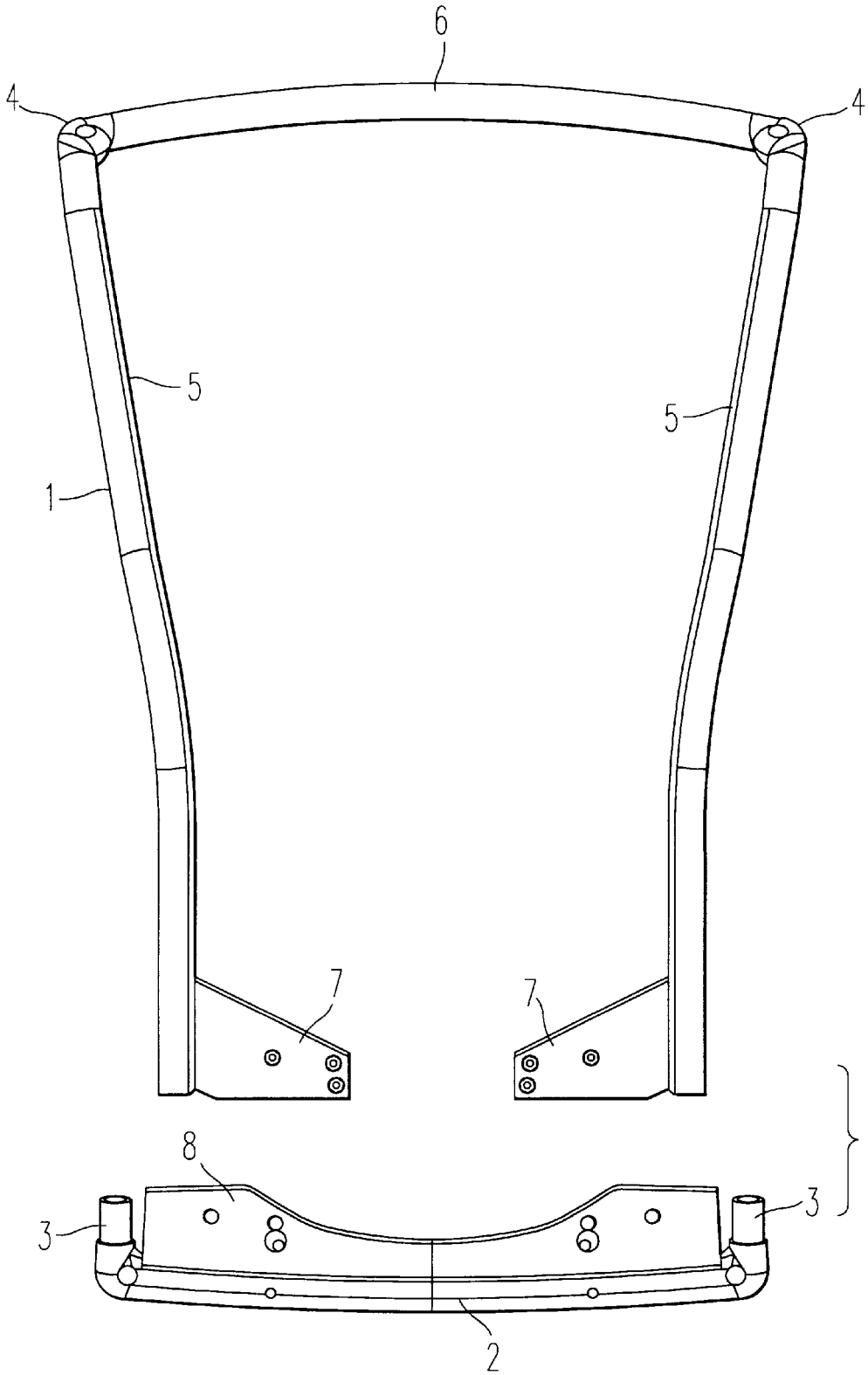
FIG. 1 shows a frame according to the invention and a transverse bow matched to it.

FIG. 1 shows a frame 1 according to the invention and an insertable transverse bow 2. The frame 1 is downwardly open and essentially consists of bent tubes. It can thus be produced in a very simple manner. The tubes are downwardly open and ready to receive corresponding pegs 3 of the transverse bow 2. The frame 1 has hinges 4 at those corners which are opposite the transverse bow 2. Depending on the desired shape of the backrest in each case, the frame has, for example, essentially the shape of an angular "U". The limbs 5 of the "U" can be pivoted with respect to the transverse connection 6 with the aid of the hinges 4. The frame 1 only assumes the final shape on insertion of the transverse bow 2. In order to fix this position, the limbs 5 are provided with fastening lugs 7 which can be screwed to a correspondingly shaped fastening plate 8 of the transverse bow and can be mechanically connected in another way.

Figure 2:
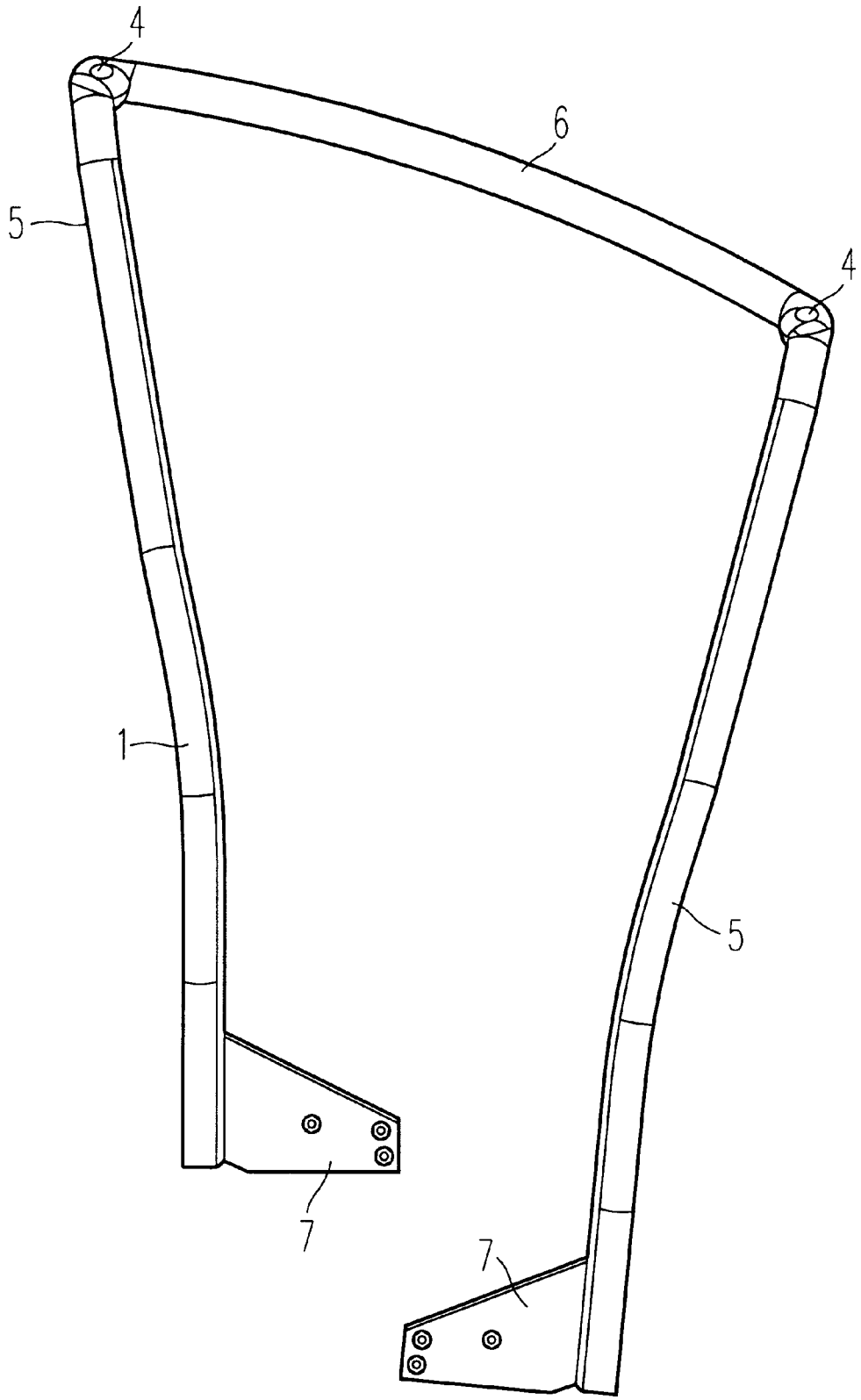
FIG. 2 shows the frame according to the invention in the rotated state.
Figure 3:
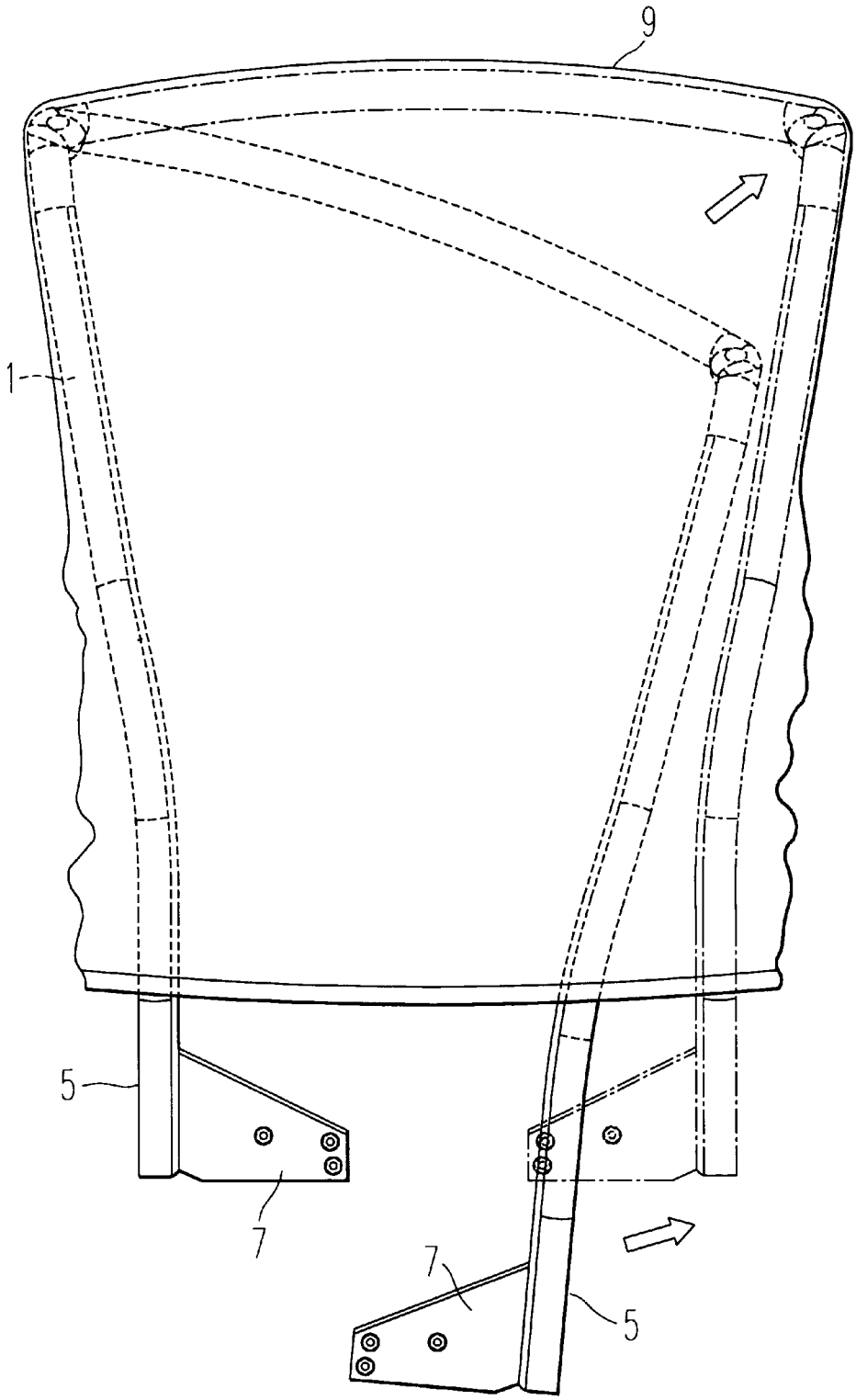
FIG. 3–7 show various stages when covering the frame with a cover.
Figure 4:
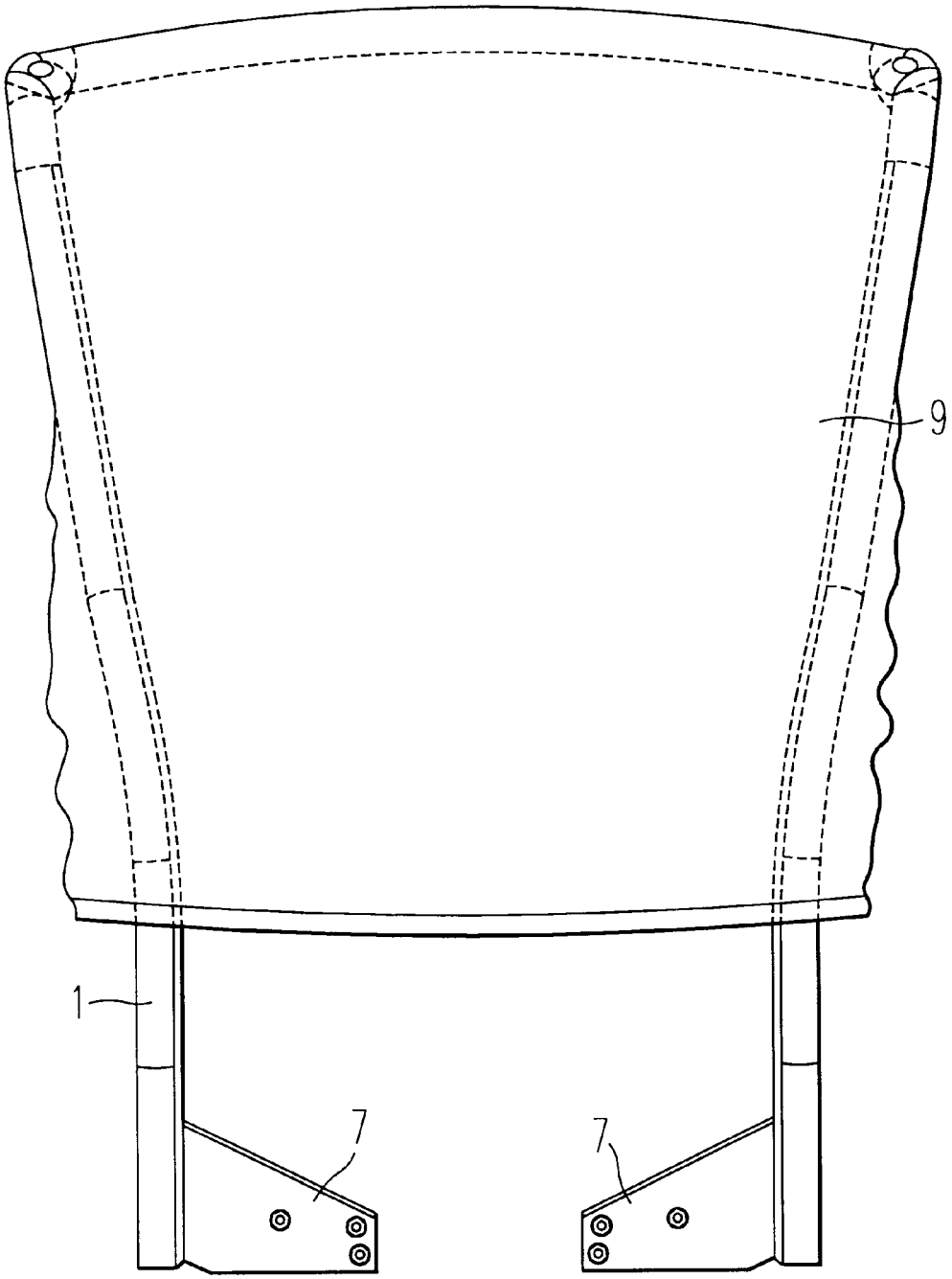
Figure 5:
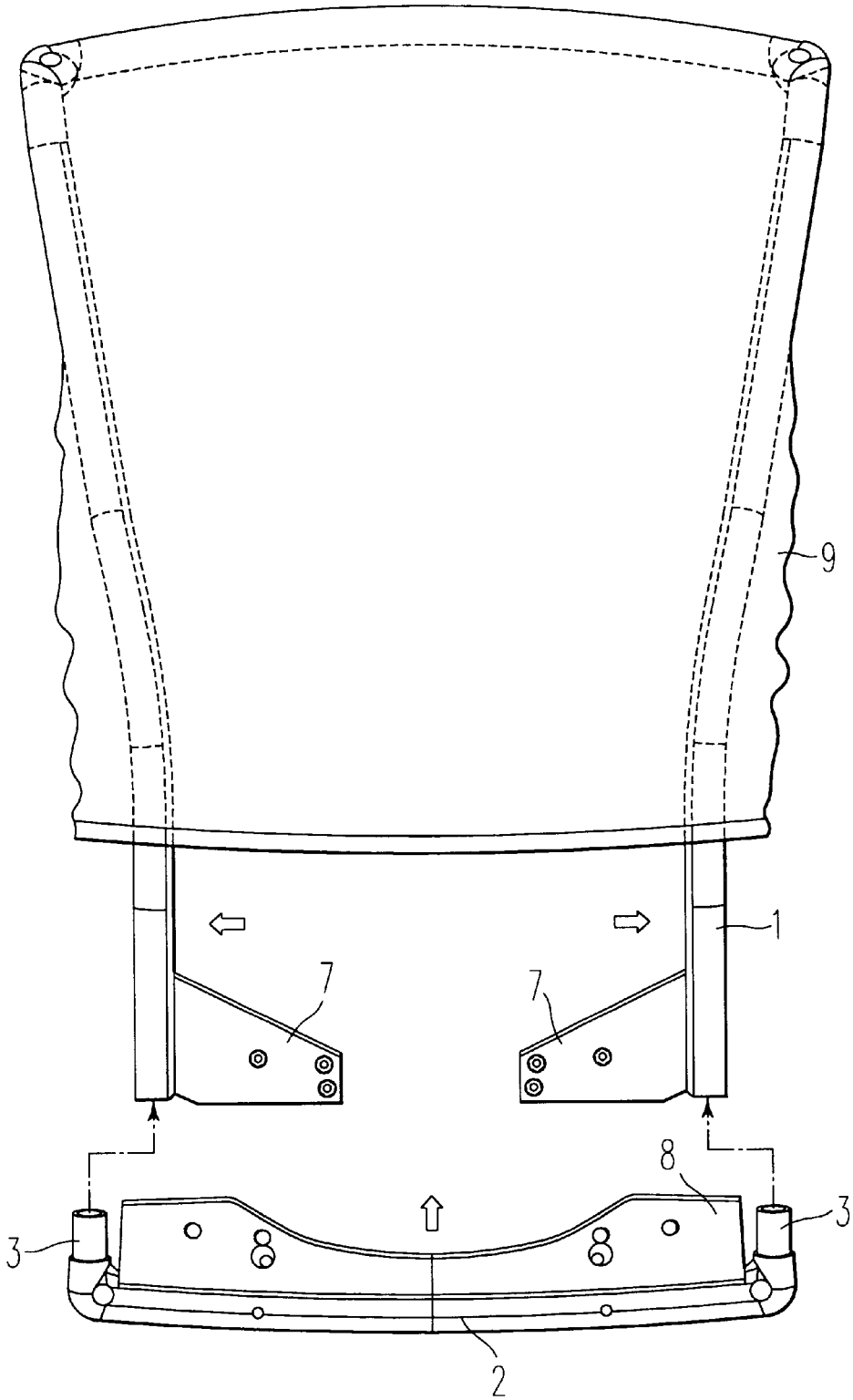
Figure 6:
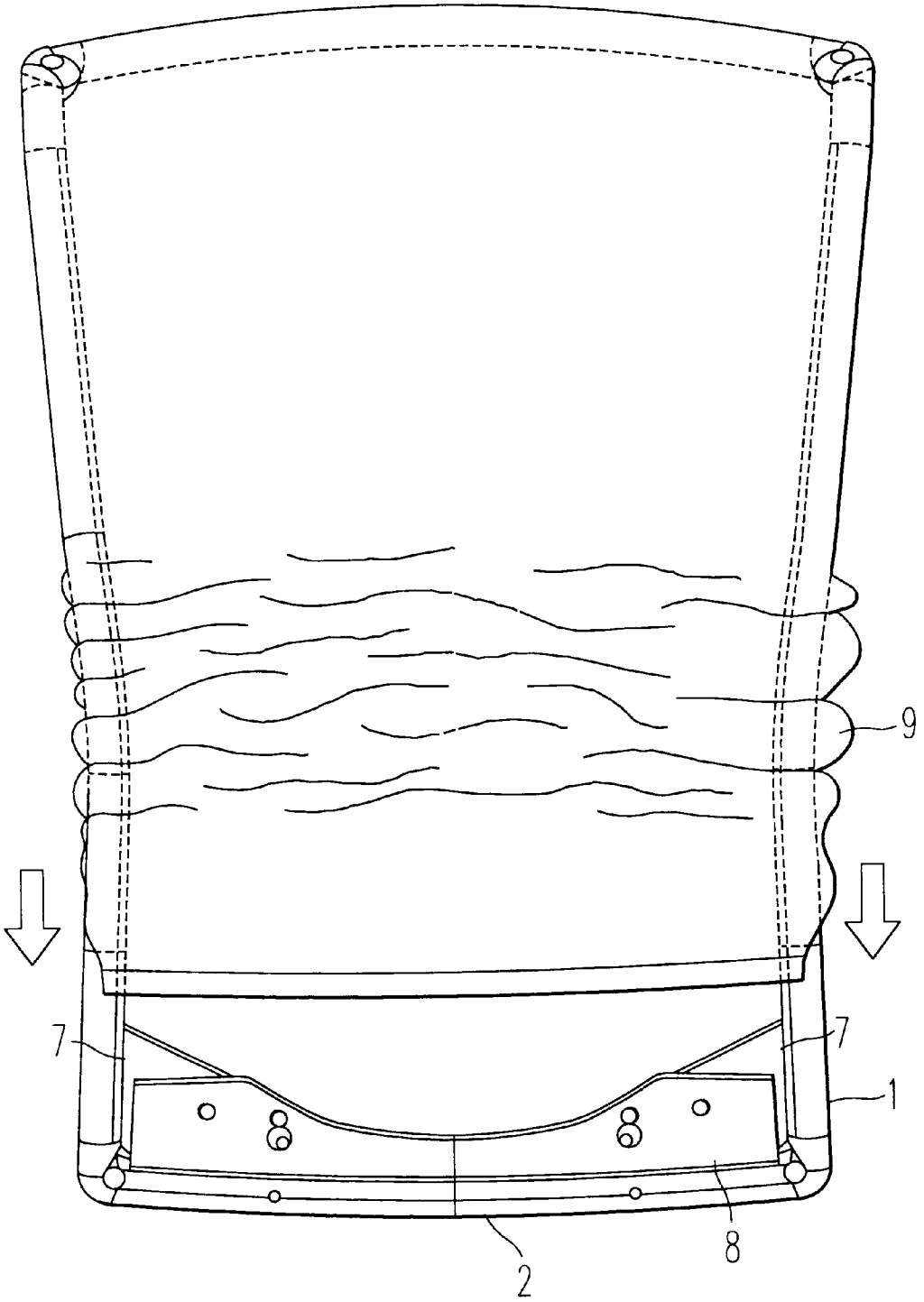
Figure 7:
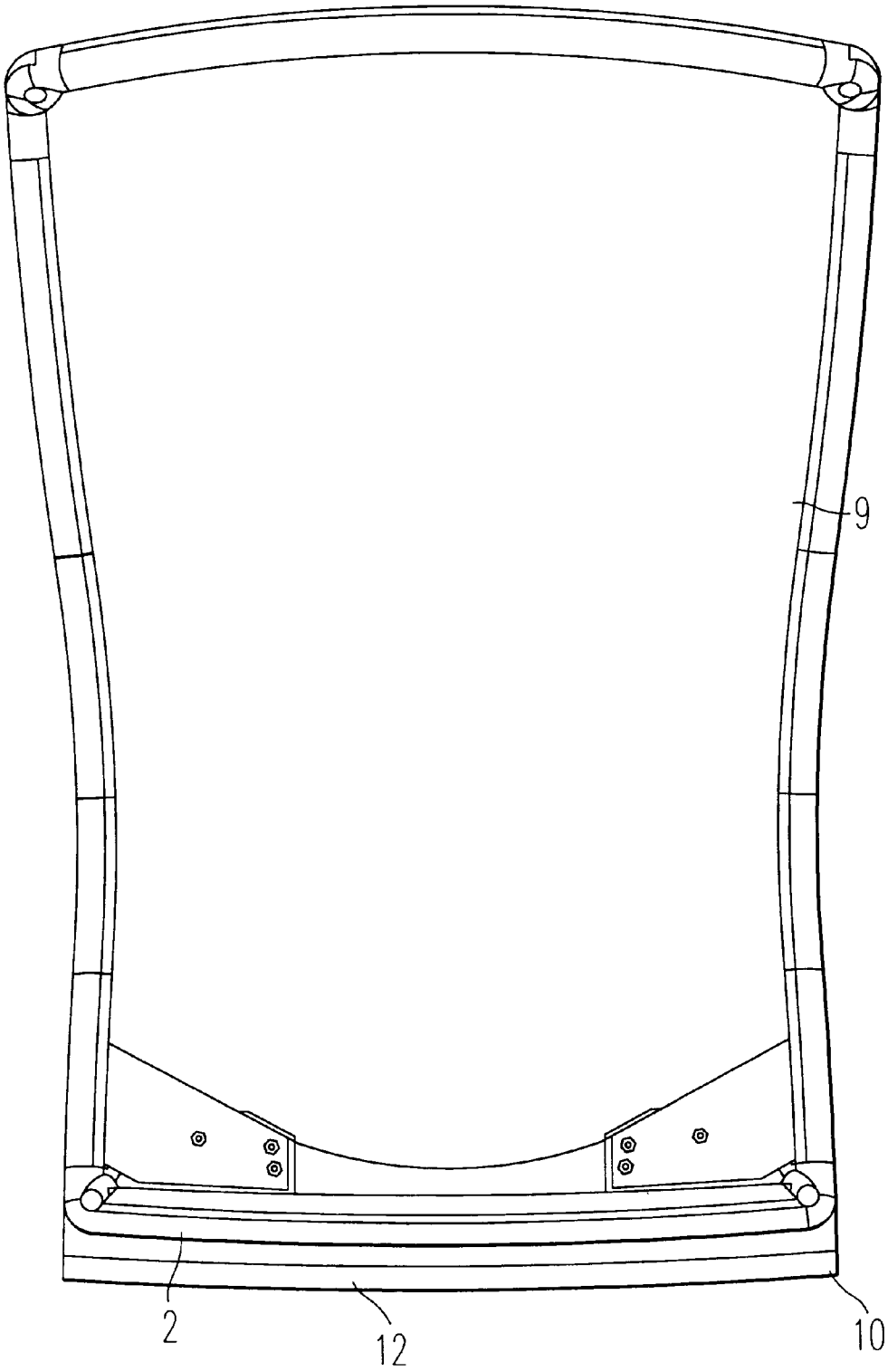
Figure 8:
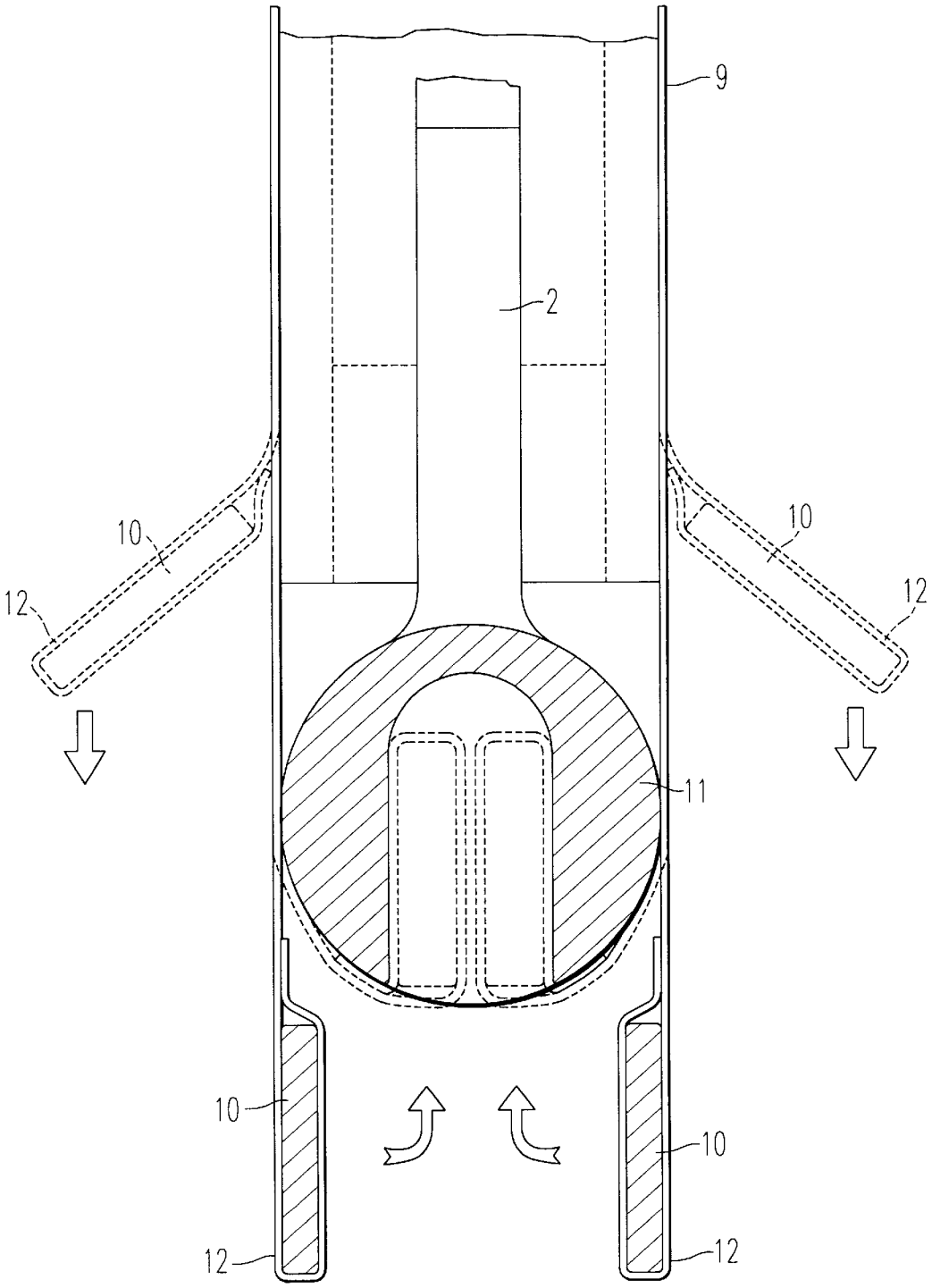
FIG. 8 shows a detail view of the transverse bow.

FIG. 2 shows how the frame 1 can be rotated on account of the hinges 4. In this manner, the frame is suitable for introducing into a sack-like cover 9. FIGS. 3 to 7 show various stages when covering the frame 1 with a cover 9. The cover 9 is of sack-like design and can be formed either by sewing or other joining together of at least two parts, or by corresponding weaving of a one-part sack. The shape of the cover 9 is essentially specified by the design of the chair and by ergonomic requirements. When covering the frame 1 with the cover 9, the limbs 5 are bent so that a first corner of the frame can be introduced into a corresponding corner of the cover (FIG. 3). The limbs 5 are then pushed toward one another until the second corner of the frame enters into that corner of the cover which is still free (FIG. 4). In this position, the cover 9 is not yet stretched in the longitudinal and transverse direction. The tensioning in the transverse direction is achieved, as is shown in FIG. 5, by the limbs 5 being pushed apart until the transverse bow 2 can be inserted into the provided openings in the frame 1 (FIG. 6). The cover 9 is then stretched towards the transverse bow to bring about longitudinal tension (FIG. 7). In order to fix the longitudinal tension brought about in this manner, the cover 9 has profiles 10 which are sewn in at its opening and can be introduced into an especially provided groove 11 in the transverse bow 2 (piping technique). FIG. 8 shows this procedure in detail. The profiles 10 are arranged in tunnels 12 sewn in on both sides of the cover. This type of fastening differs from other possibilities, which can of course likewise be used within the scope of the invention, in that there are no loose threads nor does stitching on the frame have to be undertaken subsequently. This type of fastening is not only convincing for technical reasons but also for aesthetic reasons.

Figure 9:
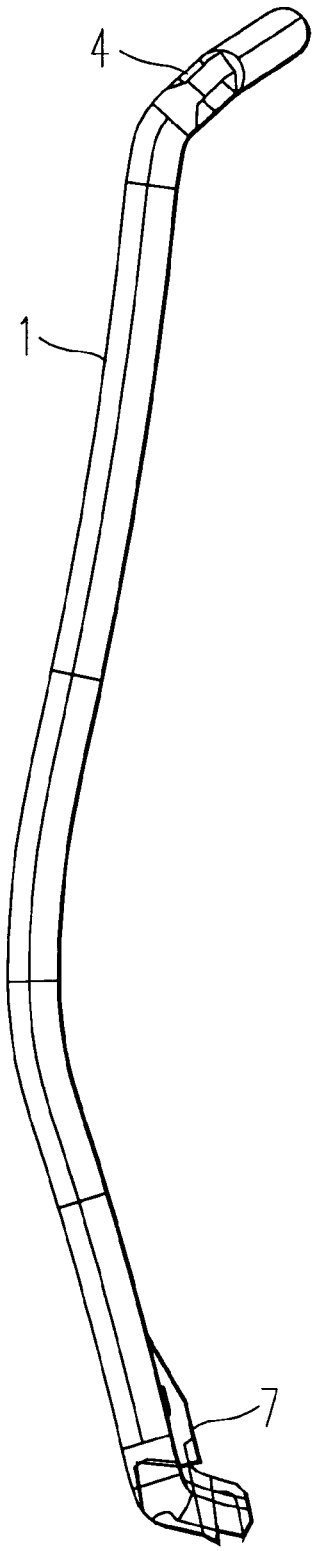
FIG. 9 shows a frame according to the invention from the side.

FIG. 9 shows the frame 1 from the side. It can clearly be seen how the limbs 5 are slightly bent and the frame 1 as a whole forms a lightweight, stepped bow. After the frame 1 has been covered with a cover, the longitudinal and transverse tensioning in the cover cause the formation of a three-dimensional shape which corresponds to an ergonomically favorable surface supporting the back. For this reason, the backrest according to the invention is very comfortable for the user. The ergonomic support by means of the three-dimensional shape of the cover surface and the good aeration of the backrest should be emphasized in particular. If desired, it is also possible to fasten an additional cushion on the cover.

In summary, the backrest according to the invention is distinguished by simple and cost-effective production and by excellent ergonomic and aesthetic characteristics.

| List of reference numbers | |
|---|---|
| 1 | Frame |
| 2 | Transverse bow |
| 3 | Peg |
| 4 | Hinge |
| 5 | Limb |
| 6 | Transverse connection |
| 7 | Fastening lug |
| 8 | Fastening plate |
| 9 | Cover |
| 10 | Profile |
| 11 | Groove |
| 12 | Tunnel |

What is claimed is:

1. A backrest, suitable in particular for an office chair, comprising a frame (1) on which a sack-like cover (9) is fastened, wherein the frame (1) is of hinged construction and the backrest has a transverse bow (2) which can be inserted into the frame (1), the frame (1) being able to be introduced into a downwardly facing opening of the cover (9) by hinged rotation, and the cover (9) being stretched in the transverse direction by insertion of the transverse bow (2) into the frame (1) and in the longitudinal direction by fastening of the cover (9) to the transverse bow (2).

2. The backrest as claimed in claim 1, wherein the frame (1) essentially has an angular U-shape and has hinges (4) at those corners which lie opposite the transverse bow (2).

3. The backrest as claimed in claim 2, wherein the frames is bent and/or rounded.

4. The backrest as claimed in claim 3, wherein the hinges (4) consist of one or a light metal or plastic.

5. The backrest as claimed in any one of the preceding claims, wherein the transverse bow (2) has at least one groove (11) into which profiles (10), which are placed on both sides into the cover (9), can be introduced.

6. The backrest as claimed in claim 4, wherein in a region of the opening, the cover (9) has, on both sides, tunnels (12) into which the profiles (10) can be inserted.

7. The backrest as claimed in claim 1, wherein the transverse bow is designed for mechanical linkage to a seat surface.

8. The backrest as claimed in claim 1, wherein the cover is adapted to have a cushion fastened thereon (9).

* * * * *